US008899330B2

(12) United States Patent
Misselbrook

(10) Patent No.: US 8,899,330 B2
(45) Date of Patent: Dec. 2, 2014

(54) DEVICES AND METHODS FOR SEVERING A TUBE-WIRE

(75) Inventor: John Gordon Misselbrook, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 330 days.

(21) Appl. No.: 13/538,410

(22) Filed: Jun. 29, 2012

(65) Prior Publication Data

US 2014/0000895 A1 Jan. 2, 2014

(51) Int. Cl.
*E21B 29/04* (2006.01)

(52) U.S. Cl.
USPC ..... 166/298; 166/54.5; 166/54.6

(58) Field of Classification Search
CPC ..... E21B 29/04
USPC ..... 166/54.5, 54.6, 55, 55.6, 298, 376; 30/92.5
See application file for complete search history.

(56) References Cited

U.S. PATENT DOCUMENTS

| | | | | | |
|---|---|---|---|---|---|
| 692,816 | A * | 2/1902 | Bell | 166/54.6 |
| 729,951 | A * | 6/1903 | Mapes | 166/54.6 |
| 756,760 | A * | 4/1904 | Wolf | 166/54.6 |
| 917,555 | A * | 4/1909 | Davin | 166/54.5 |
| 969,571 | A * | 9/1910 | Spang | 166/54.6 |
| 969,755 | A * | 9/1910 | Spang | 166/54.6 |
| 1,018,274 | A * | 2/1912 | Sheehan et al. | 166/54.6 |
| 1,125,209 | A * | 1/1915 | Taylor | 166/54.5 |
| 1,194,461 | A * | 8/1916 | Zahniser | 166/54.6 |
| 1,325,901 | A * | 12/1919 | Nichols | 166/54.6 |
| 1,381,019 | A * | 6/1921 | Samuelson | 166/54.6 |
| 1,491,610 | A * | 4/1924 | Liady | 166/54.6 |
| 1,596,608 | A * | 8/1926 | Gallman et al. | 166/54.6 |
| 1,610,699 | A * | 12/1926 | Montgomery | 166/54.6 |
| 2,185,303 | A * | 1/1940 | Kinley | 166/54.6 |
| 2,794,619 | A * | 6/1957 | Lawrence et al. | 166/54.6 |
| 3,073,388 | A * | 1/1963 | Chenault | 166/54.5 |
| 3,926,252 | A * | 12/1975 | Ribeyre et al. | 166/54.6 |
| 4,306,622 | A | 12/1981 | Armstrong | |
| 4,427,059 | A * | 1/1984 | Olivier | 166/54.6 |
| 4,738,312 | A | 4/1988 | Wittrisch | |
| 4,886,115 | A | 12/1989 | Leggett et al. | |
| 5,720,348 | A * | 2/1998 | Hisaw | 166/297 |
| 6,763,753 | B1 | 7/2004 | Brumley et al. | |
| 7,264,060 | B2 | 9/2007 | Wills | |
| 7,963,319 | B2 * | 6/2011 | Daigle et al. | 166/54.5 |
| 8,082,980 | B2 * | 12/2011 | Gillan | 166/54.5 |
| 2002/0152856 | A1 * | 10/2002 | Brumley et al. | 83/13 |
| 2010/0181072 | A1 * | 7/2010 | Gillan | 166/297 |
| 2011/0284224 | A1 * | 11/2011 | Misselbrook et al. | 166/298 |

OTHER PUBLICATIONS

Schlumberger Oilfield Glossary entries for "surface casing", "casing", and "casing string"; accessed Jul. 24, 2014 via www.glossary.oilfield.slb.com.*

* cited by examiner

*Primary Examiner* — Blake Michener
(74) *Attorney, Agent, or Firm* — Shawn Hunter

(57) ABSTRACT

A shear pig assembly and method of use for severing a linear conductor within a surrounding tubular. A shear pig assembly includes a main body and a nose that radially surround the linear conductor within the tubular. The main body and nose are axially moveable with respect to each other to cause a shear plug to move radially within a shearing chamber, thereby severing the linear conductor.

14 Claims, 4 Drawing Sheets

DEVICES AND METHODS FOR SEVERING A TUBE-WIRE

BACKGROUND OF THE INVENTION

1. Field of the Invention

The invention relates generally to systems and methods for severing a tube-wire or similar transmission conductor that is disposed in a surrounding tubular.

2. Description of the Related Art

Coiled tubing has become a popular means for running a bottom hole assembly ("BHA") into a subterranean wellbore. A wireline or tube-wire is sometimes run inside of the coiled tubing when realtime downhole data is required, such as during directional drilling or logging. Tube-wire is a tube that contains an insulated cable that is used to provide electrical power and/or data to the bottom hole assembly or to transmit data from the BHA to the surface. Tube-wire is available commercially from manufacturers such as Canada Tech Corporation of Calgary, Canada.

In the event that coiled tubing and the associated BHA become stuck in the wellbore, it is common practice to pump a ball or plug down through the coiled tubing in order to disconnect the BHA from the coiled tubing. If this fails to free the coiled tubing, then the contingency is to kill the well, cut the coiled tubing at the surface, and run a chemical cutter on wireline down through the coiled tubing in order to retrieve the coiled tubing from the well. If this problem occurs with TeleCoil, then it is necessary to retrieve the tube-wire before running the chemical cutter. The tube-wire in a TeleCoil string is comparatively weak compared to conventional braided cable, and using a tensile shear release mechanism in the BHA for the tube-wire is considered unreliable. Accordingly, the TeleCoil BHA incorporates a ball operated tube-wire release mechanism to facilitate retrieval of the tube-wire. There is no contingency available in the event of a failure of this mechanism. Conventional drop bars and "go devil" devices that are used to sever slickline rely upon gravity to be delivered to a point wherein they can sever the slickline. They are unsuitable for use in horizontal or deviated wellbores.

SUMMARY OF THE INVENTION

The invention provides devices and methods for severing a tube-wire proximate the BHA of a coiled tubing run BHA. The devices and methods described are useful in the event that the coiled tubing becomes stuck within the surrounding wellbore. An exemplary shear pig assembly is described that radially surrounds the tube-wire and is axially moveable along it. The exemplary shear pig assembly includes a main body portion and a nose. The nose may be affixed to the main body portion by a frangible connector. A shear chamber is formed between the main body portion and the nose, and a shear plug is disposed within the shear chamber. The exemplary shear pig assembly also includes a fin array that radially surrounds a shaft of the main body portion to help propel the shear pig assembly through the flowbore of the running string.

To actuate the shear pig assembly to sever the tube-wire, the shear pig assembly is moved downwardly along the tube-wire to a predetermined location wherein it is desired to sever the tube-wire. When the shear pig assembly reaches this point, the nose of the cutting assembly encounters a contact fitting within the running string which stops the downward movement of the shear pig assembly. The shear pig assembly is preferably so moved by pumping fluid into the coiled tubing running string at the surface. In particular embodiments, the shear pig assembly has a relatively short axial length that will permit it to negotiate coiled tubing that is wrapped around a reel at the surface. When the nose of the shear pig assembly contacts the contact fitting, the frangible connector is ruptured. The main body of the shear pig assembly is moved axially toward the nose causing the shear chamber to collapse axially. This collapse causes the shear plug to move radially within the shear chamber. In this embodiment, the tube-wire is severed between the shear plug and the nose as well as between the shear plug and the main body. Once severed, the tube-wire can be withdrawn from the running string.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
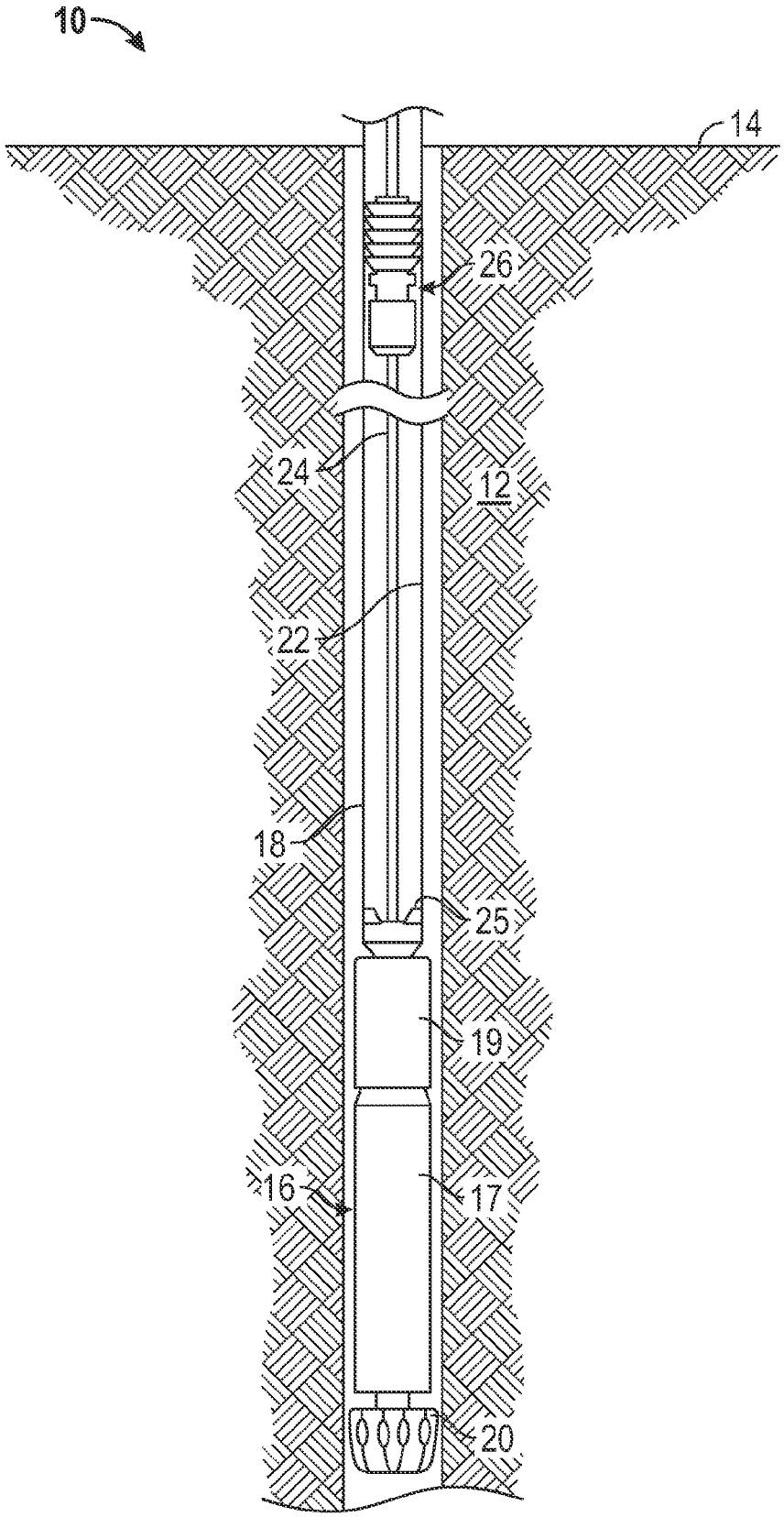
FIG. 1 is a side, cross-sectional view of an exemplary wellbore having a BHA being run in with coiled tubing and tube-wire.

FIG. 1 illustrates and exemplary wellbore 10 that has been drilled through the earth 12 from the surface 14. A bottom hole assembly (or BHA) 16 is affixed to a coiled tubing running string 18. The BHA 16 includes a mud motor 17, an electronics sub 19, and a milling bit 20 that is used to clear debris from the wellbore 10. An interior flowbore 22 is defined along the length of the running string 18, and tube-wire 24 is disposed within the flowbore 22 and is interconnected with the BHA 16 in a manner known in the art. An annular contact fitting 25 is located within the flowbore 22 just above the BHA 16.

An exemplary shear pig assembly 26, which has been constructed in accordance with the present invention, is shown radially surrounding the tube-wire 24 within the running string 18. The shear pig assembly 26 is axially moveable along the tube-wire 24 and is preferably propelled downwardly through the flowbore 22 of the running string 18 by fluid pressure, as will be described in further detail shortly.

Figure 2:
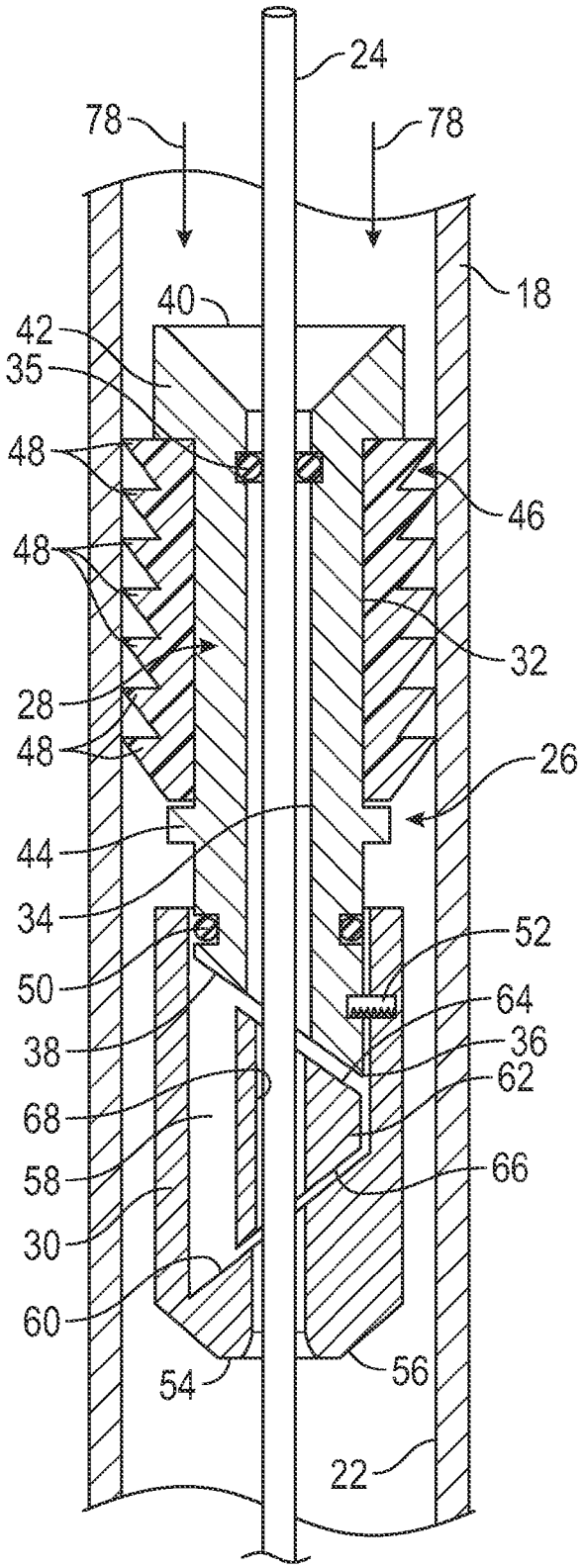
FIG. 2 is a side, cross-sectional view of an exemplary shear pig assembly constructed in accordance with the present invention and shown within the coiled tubing string and surrounding the tube-wire.
Figure 3:
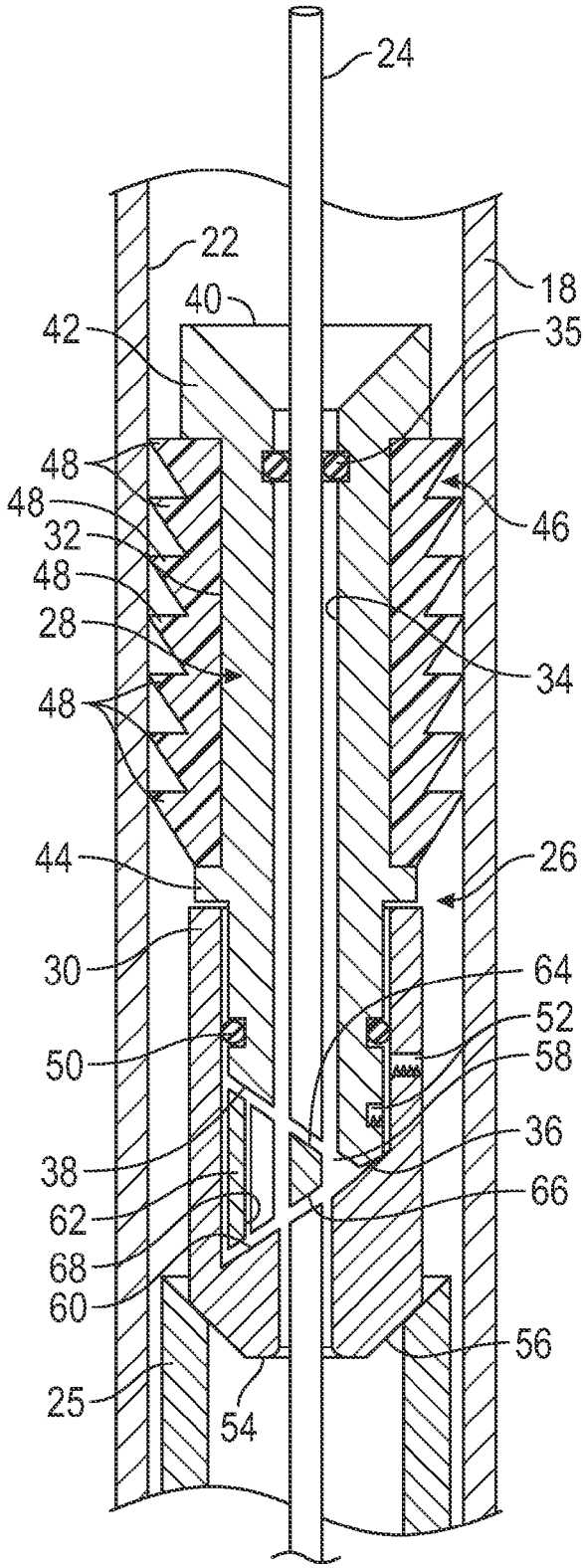
FIG. 3 is a side, cross-sectional view of the shear pig assembly of FIG. 2, now having been actuated to sever the tube-wire.

The exemplary shear pig assembly 26 is shown in greater detail in FIGS. 2 and 3. The shear pig assembly 26 includes a main body 28 and a separate nose 30. The main body 28 has a central shaft 32 with a central axial passage 34 disposed along its length. An annular fluid seal 35 is provided between the shaft 32 and the tube-wire 24. In the depicted embodiment, the distal end 36 of the shaft 32 presents an angled face 38. The proximal end 40 of the shaft 32 preferably presents an enlarged diameter portion 42. In certain embodiments, an annular flange 44 projects radially outwardly from the shaft 32.

Also in particular embodiments, an annular fin array 46 radially surrounds the shaft 32 between the enlarged diameter portion 42 and the flange 44. The fin array 46 preferably includes a plurality of angled fins 48 or cups that are shaped to receive and contain fluid pumped from the surface 14. In particular embodiments, the fin array 46 is formed of polyurethane or a similar resilient material. In preferred embodiments, the fins 48 of the fin array 46 extend radially outwardly to contact the surrounding running string 18.

The nose 30 of the pig assembly 26 radially surrounds the distal end 36 of the shaft 32. An o-ring fluid seal 50 provides a fluid seal between the nose 30 and the shaft 32. A frangible connector in the form of a shear pin 52 preferably secures the nose 30 to the shaft 32. The nose 30 also preferably presents a distal end 54 having an annular angled surface portion 56.

A generally wedge-shaped shearing chamber 58 is defined axially between the nose 30 and the shaft 32. The shearing chamber 58 is wedge-shaped due to the presence of the angled face 38 of the shaft 32 and an oppositely-angled interior face 60 that is presented by the nose 30.

A shear plug 62 is retained within the shearing chamber 58. The shear plug 62 is generally cylindrical with a first angled surface 64 that is complimentary to the angled face 38 of the shaft 32 and a second angled surface 66 that is complimentary to the angled face 60 of the nose 30. A central passage 68 is disposed through the shear plug 62, and the tube-wire 24 passes through the passage 68.

Figure 4:
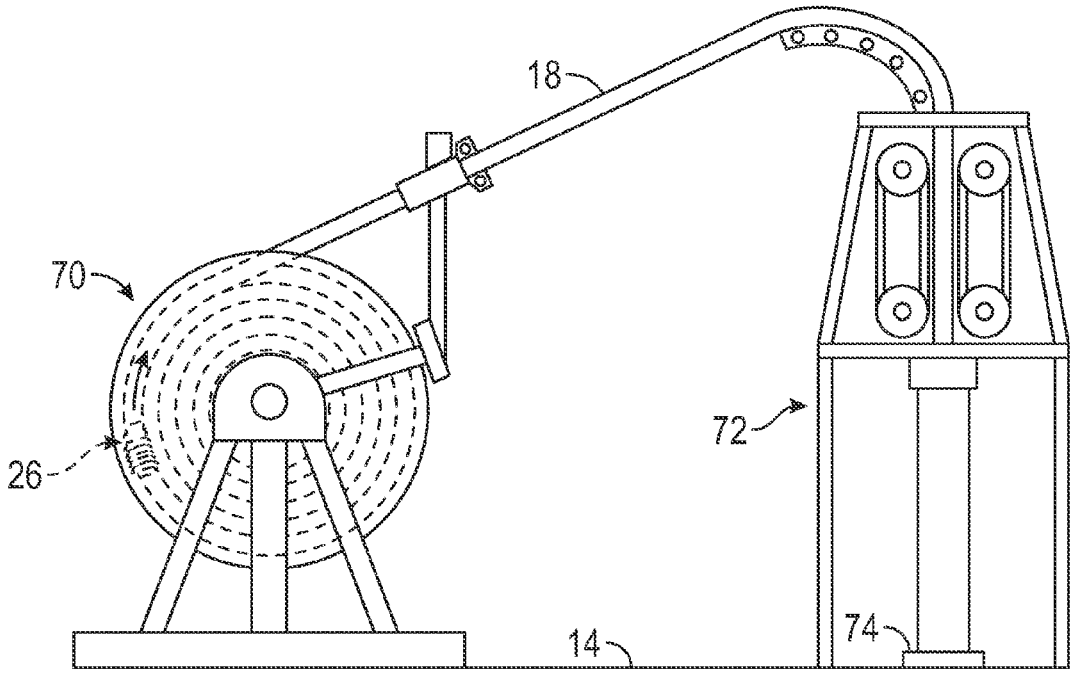
FIG. 4 is a schematic, side view, partially in cross-section depicting a shear pig assembly in accordance with the present invention being pumped through coiled tubing on a reel.
Figure 5:
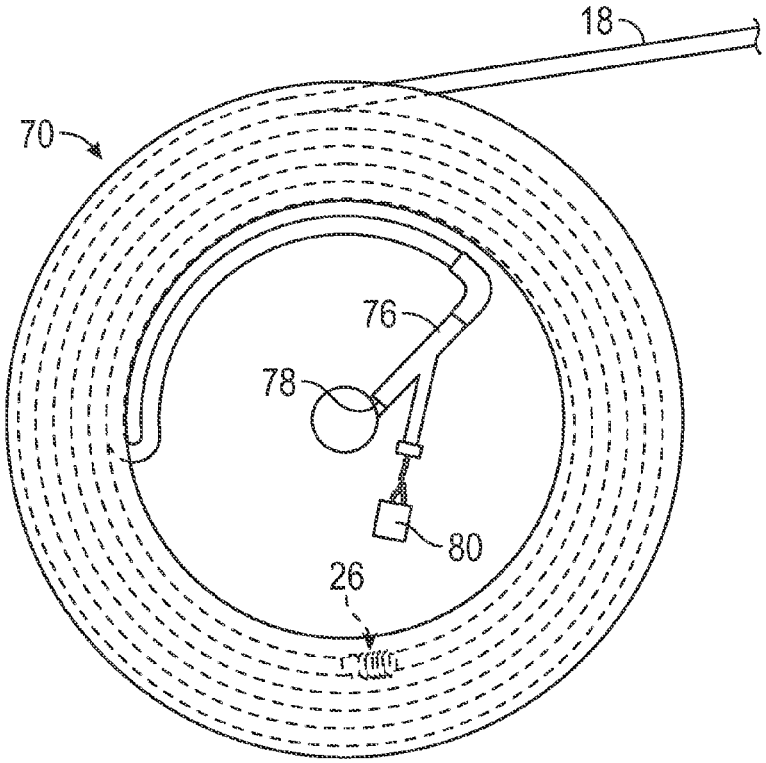
FIG. 5 is a further view of the coiled tubing reel shown in FIG. 4 apart from other components.

In operation, the coiled tubing 18 and the BHA 16 are used to remove obstructions from the wellbore 10. In the event that the BHA 16 becomes stuck in the wellbore 10 and conventional methods for freeing the BHA 16 fail, the shear pig assembly 26 can be used to sever the tube-wire 24 proximate the BHA 16. In one embodiment, illustrated in FIGS. 4 and 5, the shear pig assembly 26 is introduced into the coiled tubing running string 18 at the surface 14. The coiled tubing 18 is shown spooled around reel 70. During operation, the coiled tubing 18 is unspooled from the reel 70 and then injected by an injector arrangement 72 through wellhead 74 and into the wellbore 10 below. FIG. 4 depicts the reel 70 having a manifold 76 with a lateral branch 78 into which the shear pig assembly 26 can be introduced around the tube-wire 24. The tube-wire 24 is supplied from a reel 80. After being inserted into the coiled tubing 18 at the reel 70 a fluid pump (not shown) is used to pump the shear pig assembly 26 through the coiled tubing 18 around the reel 70 and then through the coiled tubing 18 as it runs through the injector 72 and then down into the wellbore 10. It is noted that the shear pig assembly 26 is preferably of a small size and short axial length such that it is capable of negotiating the bends of the coiled tubing 18 when it is coiled around the reel 70 as it is pumped through the flowbore of the coiled tubing 18. In preferred embodiments, the shear pig assembly 26 has an axial length of only a few inches.

Alternatively, the coiled tubing 18 could be cut at surface 14 to expose the tube wire 24. A launching assembly (not shown) of a type known in the art would then be attached to the coiled tubing 18. The shear pig assembly 26 would be guided over the tube-wire 24 and pushed into the launching assembly. A pack-off (not shown) would be installed around the tube-wire 24 at the top of the launching assembly. A pump (not shown) is then hooked up to the launching assembly and then the shear pig assembly 26 can be pumped down the coiled tubing 18 in the wellbore 10.

Once the shear pig assembly 26 has been launched or pumped through the reel 70, it will be located within the flowbore 22 of the coiled tubing 18, as illustrated in FIG. 1, proximate the surface 14. An associated fluid pump (not shown) flows fluid into the flowbore 22 of the coiled tubing 18, as illustrated by the arrows 78 in FIG. 2. Fluid pressure acts upon the proximal end 40 of the main body 28, including the enlarged diameter portion 42 and the fins 48, thereby moving the shear pig assembly 26 downwardly within the flowbore 22 until it reaches the annular contact fitting 25, as shown in FIG. 3. The annular angled surface portion 56 of the distal end 54 of the nose 30 contacts the contact fitting 25 and seals, allowing fluid pressure to build up at the proximal end 40 of the main body 28. Further fluid pressure from the surface 14 will thereafter rupture the frangible shear pin 52. The distal end 36 of the shaft 32 will be urged axially downwardly with respect to the nose 30. Axial compression of the shear plug 62 between the angled faces 38, 60 will cause the shear plug 62 to be moved radially outwardly within the shear chamber 58, as illustrated in FIG. 3. The first angled surface 64 slides upon the angled face 38 while the second angled surface 66 slides upon the angled face 60. As the shear plug 62 is moved radially outwardly within the shear chamber 58, the tube-wire 24 is severed by shearing between the shear plug 62 and the neighboring main body 28 and the nose 30, as illustrated in FIG. 3. As can be seen by reference to FIG. 3, the tube-wire 24 is severed between the shear plug 62 and the nose 30 as well as between the shear plug 62 and the main body 28. The severed tube-wire 24 can now be withdrawn from the flowbore 22 of the running string 18. It can be seen that the main body 28 and the nose 30 are axially moveable with respect to each other between a first position, shown in FIG. 2 wherein the shearing chamber 58 is axially expanded, and a second position, shown in FIG. 3 wherein the shearing chamber 58 is axially collapsed. The shear pin 52 releasably secures the main body 28 and nose 30 in the first position prior to actuation. After the tube-wire 24 is sheared downhole, it can be pulled out of the coiled tubing 18 either by using the coiled tubing reel 70 to pull it out or by cutting the tube-wire 24 on surface 14 and attaching it to a wireline winch of a type known in the art. Once the tube-wire 24 is removed, an electric wireline unit of a type known in the art can be rigged up and a chemical or plasma cutter, of types known in the art, loaded into a lubricator and pumped downhole, as is known in the art.

Those of skill in the art should understand that the exemplary shear pig assembly 26 described herein could be used in other situations wherein it is desired to sever a linear conductor other than tube-wire within a surrounding tubular other than a coiled tubing running string. Such alternative linear conductors might include slickline, light cable or small tubing.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A shear pig assembly for severing a linear conductor within a surrounding tubular, the shear pig assembly comprising:

a main body that radially surrounds the linear conductor;

a nose that radially surrounds the linear conductor and a portion of the main body;

a shearing chamber defined between the main body and the nose;

the nose and the main body being axially moveable with respect to each other between a first position wherein the shearing chamber is axially expanded and a second position wherein the shearing chamber is axially collapsed;

a shear plug residing within the shearing chamber;

a passage piercing and being disposed through the shear plug and wherein the linear conductor passes through the passage, and wherein a frangible connector releasably secures the nose and main body in the first position; and the shear plug severing the linear conductor as the nose and main body are moved to the second position by movement of the shear plug radially outwardly within the shearing chamber.

2. The shear pig assembly of claim 1 wherein:

the shearing chamber is generally wedge-shaped; and the shear plug is generally wedge-shaped such that axial collapse of the shearing chamber will move the shear plug laterally within the shearing chamber to sever the linear conductor.

3. The shear pig assembly of claim 1 further comprising a fin that extends radially outwardly from the main body to contact the surrounding tubular.

4. The shear pig assembly of claim 1 wherein the shear pig assembly is transmitted through the surrounding tubular by fluid pressure.

5. A system for severing a linear conductor within a surrounding tubular comprising:

a shear pig assembly having:

a) a main body and nose that each radially surround the linear conductor, a shearing chamber defined between the main body and the nose;

b) the nose and the main body being axially moveable with respect to each other between a first position wherein the shearing chamber is axially expanded and a second position wherein the shearing chamber is axially collapsed, and wherein a frangible connector releasably secures the nose and main body in the first position;

c) a shear plug residing within the shearing chamber, a passage piercing and being disposed through the shear plug with the linear conductor passing through the passage, the shear plug severing the linear conductor by movement of the shear plug radially outwardly within the shearing chamber as the nose and main body are moved to the second position; and a contact fitting dispOsed within the surrounding tubular, the contact fitting contacting the nose of the shear pig assembly to cause the nose and main body to be moved to the second position.

6. The system of claim 5 wherein the shear pig assembly is disposed within a coiled tubing running string.

7. The system of claim 5 wherein the linear conductor comprises tube-wire.

8. The system of claim 5 wherein:

the shearing chamber is generally wedge-shaped; and the shear plug is generally wedge-shaped such that axial collapse of the shearing chamber will move the shear plug laterally within the shearing chamber to sever the linear conductor.

9. The system of claim 5 further comprising a fin that extends radially outwardly from the main body to contact the surrounding tubular.

10. The system of claim 5 wherein the shear pig assembly is transmitted through the surrounding tubular by fluid pressure.

11. A method for severing a linear conductor within a surrounding tubular, the method comprising the steps of:

disposing a shear pig assembly within the surrounding tubular, the shear pig assembly having a main body and a nose that radially surround the linear conductor and define a shearing chamber therebetween, the nose and the main body being axially moveable with respect to each other between a first position wherein the shearing chamber is axially expanded and a second position wherein the shearing chamber is axially collapsed;

urging the nose of the shear pig assembly against a contact fitting within the surrounding tubular, contact with the fitting moving the nose and main body to the second position thereby rupturing a frangible connector as the nose and main body are moved from the first position to the second position; and severing the linear conductor upon axial collapse of the shearing chamber by moving a shear plug radially out of the shearing chamber, the shear plug having a passage piercing and passing therethrough and through which the linear conductor is disposed.

12. The method of claim 11 further comprising the step of moving the shear pig assembly within the surrounding tubular to the contact fitting under impetus of fluid pressure within the surrounding tubular.

13. The method of claim 11 further comprising the step of removing the linear conductor from the surrounding tubular after severing.

14. The method of claim 11 wherein movement of the shear plug within the shearing chamber severs the linear conductor between the shear plug and the main body as well as between the shear plug and the nose.

* * * * *

UNITED STATES PATENT AND TRADEMARK OFFICE

CERTIFICATE OF CORRECTION

PATENT NO. : 8,899,330 B2
APPLICATION NO. : 13/538410
DATED : December 2, 2014
INVENTOR(S) : Misselbrook It is certified that error appears in the above-identified patent and that said Letters Patent is hereby corrected as shown below:

In the Claim

Column 5, line 46, Claim 5 delete "dispOsed" and insert --disposed--.

Signed and Sealed this
Third Day of March, 2015

Michelle K. Lee

Michelle K. Lee
*Deputy Director of the United States Patent and Trademark Office*